US009834901B2

(12) United States Patent
Angelov

(10) Patent No.: US 9,834,901 B2
(45) Date of Patent: Dec. 5, 2017

(54) SUPPORT DEVICE AND METHOD FOR THE APPLICATION THEREOF

(71) Applicant: VizionZ Engineering B.V., Delft (NL)

(72) Inventor: Zdravko Angelov, The Hague (NL)

(73) Assignee: VizionZ Engineering B.V., Delft (NL)

( * ) Notice: Subject to any disclaimer, the term of this patent is extended or adjusted under 35 U.S.C. 154(b) by 0 days.

(21) Appl. No.: 15/303,978

(22) PCT Filed: Apr. 8, 2015

(86) PCT No.: PCT/NL2015/050227
§ 371 (c)(1),
(2) Date: Oct. 13, 2016

(87) PCT Pub. No.: WO2015/160240
PCT Pub. Date: Oct. 22, 2015

(65) Prior Publication Data

US 2017/0030044 A1 Feb. 2, 2017

(30) Foreign Application Priority Data

Apr. 16, 2014 (NL) ..... 2012640

(51) Int. Cl.
*E02D 27/42* (2006.01)
*E02D 7/00* (2006.01)

(52) U.S. Cl.
CPC ..... *E02D 27/42* (2013.01); *E02D 7/00* (2013.01); *E02D 27/425* (2013.01)

(58) Field of Classification Search
CPC ..... E02D 27/42; E02D 27/425; E02D 27/52; E02D 7/00; E02D 27/34; F03D 13/22
USPC ..... 405/232, 204, 207, 224, 226
See application file for complete search history.

(56) References Cited

U.S. PATENT DOCUMENTS 3,636,718 A * 1/1972 Keats ..... E02D 5/32 405/248
6,488,446 B1 * 12/2002 Riemers ..... B63B 21/27 114/296
2011/0091287 A1 * 4/2011 Polo ..... E02D 27/42 405/204
2012/0282036 A1 * 11/2012 Taenaka ..... E02B 17/027 405/224.2
2012/0282037 A1 * 11/2012 Luppi ..... E02D 27/52 405/227

(Continued)

FOREIGN PATENT DOCUMENTS

WO 2013076351 A1 5/2013

OTHER PUBLICATIONS

International Search Report and Written Opinion of Application No. PCT/NL2015/050227 dated Jul. 17, 2015.

*Primary Examiner* — Carib A Oquendo
(74) *Attorney, Agent, or Firm* — Thomas | Horstemeyer, LLP

(57) ABSTRACT

The present disclosure relates to a support device. The support device can include a hollow elongate member being in the form of a pile, a substantially fluid tight confined space within the hollow elongate member with at least a first seal at a distance above ground level, wherein a first fluid is arranged in the confined space, and at least one damping means is arranged in pressure connection with the first fluid in the confined space. Furthermore, the disclosure provides a method for the application of the support device.

19 Claims, 14 Drawing Sheets

(56) References Cited

U.S. PATENT DOCUMENTS

| | | | | |
|---|---|---|---|---|
| 2016/0265514 | A1* | 9/2016 | Cook | F03D 13/20 |
| 2017/0058474 | A1* | 3/2017 | Haigh | E02B 17/027 |

* cited by examiner

SUPPORT DEVICE AND METHOD FOR THE APPLICATION THEREOF

CROSS-REFERENCE TO RELATED APPLICATIONS

This application is the National Stage of International Application No. PCT/NL2015/050227, filed 8 Apr. 2015, having the title "FOUNDATION" which claims the benefit of and priority to Netherlands Application No. 2012640, filed on 16 Apr. 2014, the contents of all of which are incorporated by reference as if fully set forth herein.

TECHNICAL FIELD

The present invention relates to a support device comprising a hollow elongate member, more particular a pile.

The invention is further related to a method for the application of such a support device.

BACKGROUND

Support devices that are the subject of the invention, are e.g. 'oil & gas' structures and wind turbine structures. These prior art structures can be roughly divided into two parts, i.e. a superstructure and a substructure or foundation. The superstructure forms the topside, i.e. in 'oil & gas' platforms or the 'rotor and tower' in wind turbines. The substructure (or foundation) typically are jackets in 'oil and gas' platforms, and for wind turbines, the substructure is formed by monopiles, triples, tripods or jackets.

There are several alternative designs of substructures (foundations) for 'oil & gas' and wind turbines: monopoles, jackets, more particularly jackets with piles through the legs and jackets with skirt piles, triples and tripods. The latter substructures are normally fixed to the soil by other tubular elements—piles—which secure the soil-substructure interactions.

A monopile substructure normally comprises the pile itself and a transition piece on top, also a tubular element.

Forces (Load) loading the substructure—the superstructure (rotor for turbines/topside for 'oil and gas'), waves and current—are transferred to the substructure, and through the piles to the soil by means of friction forces on the (shaft) pile outside and the plug inside in the case the pile is open. The forces from the plug are further transferred to the soil through end-bearing forces.

With piles closed on the bottom side, there are no friction forces on the inside and the only soil reactions are the friction forces on the outside of the shaft and the (end)-bearing forces on the tip.

Substructures are subjected to large Ultimate Limit States (ULS)) and extreme (ExtremeLS, hurricanes) static compression loads (in the case of 'oil and gas') or large bending loads (in the case of wind turbines), which requires additional material in the structure to achieve sufficient strength and not to lose stability of the form (i.e. no occurrence of buckling).

Furthermore, substructures are also dynamically loaded in a broad frequency band created by waves and wind, which inevitably gets very close to the natural frequency of the substructure itself and the dynamic response (Dynamic Amplification Factor (DAF)) is very high, thus, resulting in very high loads. The damping of the substructures is normally very low (structural damping only) which means that the load is not reduced significantly and remains high. This high dynamic loading also requires the use of more material to achieve the required lifetime (fatigue) of the substructure.

The majority of piles are driven open ended which means that the interaction with the soil is mostly through friction forces. These friction forces are strongly dependent on the vibrations of the substructures. Because the vibrations are a lot, the pile has to be long (beneath the mudline) and/or with a larger diameter. On the other hand, the friction limit of the soil is 100 kPa, while the end-bearing limit of the pile (which is not used) is 10 MPa thus 100 times lower and this means that piles that primarily utilize friction have to be longer. A further disadvantage of the open piles is that the friction damping (currently used) is 2 times lower that then the end-bearing damping of the soil, which isn't used. This means that either longer piles or additional dampers in the super/substructure are needed.

Piles are very rarely driven in the soil with a closed bottom end because this requires much more energy and an increased wall thickness. Once driven open ended, the end-bearing capacity of these piles is not utilized. As a result, substructures for large loads and loads with a wide frequency spectrum tend to be heavy and expensive.

There is a need to improve prior art substructures with respect to their weight, strength, stiffness, stability and buckling safety, i.e. to provide an improved dynamic behavior and pile capacity.

SUMMARY

An object of the present invention is to provide a support device, that is improved relative to the prior art and wherein at least one of the above stated problems is obviated.

Such objectives as indicated above, and/or other benefits or inventive effects, are attained according to the present disclosure by the assembly of features in the appended independent device claim and in the appended independent method claim.

Said object is achieved with the support device according to the present invention, comprising:

- a hollow elongate member, more particular a pile;
- a substantially fluid tight confined space with at least a first seal at a distance above ground level;
- wherein a first fluid is arranged in said confined space; and
- wherein at least one damping means is arranged in pressure connection with said first fluid in said confined space.

The larger the volume of the confined space, the bigger amount of damping can be achieved, and therefore the first seal is arranged 'at a distance above the ground level'. Where only a limited amount of damping suffices, the distance at which the first seal is arranged above the ground level or a second seal may however be limited. When the hollow elongate member of the support device deforms under loading thereof, the deformation of the confined space will create pressure differences that cooperate with the damping means that is arranged in pressure connection with said first fluid in said confined space.

According to a preferred embodiment, the first fluid in said confined space of said elongate member comprises a liquid. Using a liquid as first fluid has the advantage that it behaves substantially incompressible. Preferably water is used, as this is—especially offshore—readily available and cost effective.

According to a further preferred embodiment, said device further comprises a fluid pump configured for pressurizing and/or for adjusting the pressure of the first fluid inside said confined space. Typical operating pressures for the first fluid comprise 4-10 bar.

According to a further preferred embodiment, said fluid pump is arranged at the lower half of the distance between the ground level and the top of the hollow elongate member. In case of an offshore application, the pump will be arranged below the water level, allowing the pump to benefit from the water pressure at that specific depth.

In order to protect the pump from the environment, said fluid pump is arranged inside said hollow elongate member in a further preferred embodiment. If the cross section of the attachment of said pump is elliptical according to a further preferred embodiment, this enables easier removal and replacement.

According to an even further preferred embodiment, the damping means comprise a compressible volume that is in direct or indirect contact with the first fluid inside said confined space.

Although the damping means might comprise a foam or other compressible material with elastic properties, such as the soil, the damping means comprise a gas according to a further preferred embodiment.

If the device further comprises a gas pump configured for adjusting the pressure of the gas inside said damping means, the damping characteristics can be adjusted.

According to a further preferred embodiment, the damping means are an integrated part of the first seal, allowing for easy accessibility which is advantageous for maintenance.

According to a further preferred embodiment, the device comprises at least one dividing wall with one or more restriction openings in the pressure connection between the at least one damping means and the first fluid in said confined space.

If the device, according to a still further preferred embodiment comprises at least two dividing walls with one or more restriction openings each, wherein said dividing walls are movable relative to each other in order to adjust the alignment of said one or more restriction openings in said dividing walls, the damping characteristics can be tuned in an even broader range and more accurate. Furthermore, it provides an opportunity to compensate for a difference in surrounding pressure. After all, the fluid pressure of the first fluid inside the confined space may differ, and also the height position where the damping means, i.e. the depth in the surrounding fluid, will influence the ambient pressure.

Although the holes in a particular dividing wall may all have the same size, different damping means may comprise openings with different size in order to optimize said damping means for a specific depth in said first fluid.

Furthermore, it is noted that the shape and size of openings in one or more cooperating dividing walls in a single damping means may differ in order to provide additional adjustability.

According to a further preferred embodiment, the dividing walls are rotatable relative to each other, obtaining the advantage of being able to align the said wall openings for different flow resistance to the said first fluid.

If, according to a further preferred embodiment, the damping means has a rotation symmetric cross section, the dividing walls may e.g. be part of a substantially cylindrical tube or sphere, achieving the further advantage that the stresses from the fluid flow and pressure differences are evenly distributed over the surface of the shape/dividing walls.

According to a further preferred embodiment, a fluid tight flexible member is arranged between the first fluid inside the confined space of the hollow elongate member and the at least one damping means, and wherein the volume between the fluid tight flexible member and the damping means comprises a second fluid that is different from the first fluid. A membrane, that functions as a fluid tight flexible member, divides the pressure connection into two physical divided spaces that each comprise a fluid that transfers the pressure from the enclosed space inside said hollow elongate member to the at least one damping means. The impermeable flexible member, that may be a rubber membrane, divides the two fluids.

If, according to a still further preferred embodiment, the second fluid is a liquid that has a higher viscosity than the first liquid, e.g. oil, this has the advantage that it gives a higher energy dissipation when flowing through the restriction openings of the dividing walls.

Although the damping means may be arranged at an accessible place at or near the upper end of the hollow elongate member, further adjustability of the damping characteristics is obtained when at least one damping means is arranged inside said substantially fluid tight confined space of the hollow elongate member, and wherein the position of this at least one damping means inside said confined space is adjustable and/or predetermined. The term 'adjustable' is to be interpreted as allowing the damping means to be arranged on an optimal depth, but explicitly also includes the situation wherein said damping means is fixed after the damping means is adjusted to be positioned at the desired depth.

According to a further preferred embodiment, the device further comprises a control means configured for regulating the damping in a predetermined range. The control means regulate the damping based on processing inputs such as the substructure loads (e.g. wind, waves and current) and adjust the damping of energy and vibrations of the damping means e.g. by adjusting the pressure of said first fluid through said pump and/or the alignment of said dividing walls.

According to a further preferred embodiment, the damping means comprises a second seal. Although a damper that is supported by the soil, i.e. wherein the ground functions as a soil plug, may be used as the sole damper of the support device, it may also be used in addition to other damping means.

According to a further preferred embodiment, said first and/or second seals are attached in a fixed manner in their circumference to the wall of said elongated member, allowing for an easy way of achieving water tightness.

If, according to a further preferred embodiment, said first and second seals are attached in a sliding manner in their circumference to the wall of said elongated member, then the further advantage is obtained that said seal is not loaded by the internal fluid pressure (and through it loading the member wall)—instead of deforming to keep the contact with the soil, it slides vertically, while still keeping full contact with the soil.

According to a further preferred embodiment, said second seal comprises a means of stretching and sealing it to the inside wall of said elongate member, allowing for an easier and cheaper installation.

According to a further preferred embodiment, said second seal is compressible, allowing it to stretch out in a (horizontal) direction and create a water tight connection to the inner wall of the hollow elongate member.

According to a further preferred embodiment, said second seal further comprises transferring means configured for transferring fluid into the soil that is surrounded by the hollow elongate member. This allows the soil, down to a predetermined depth, to be saturated with a fluid comprising a viscosity that is higher than said first fluid, e.g. oil, increasing the energy dissipation.

The invention is further related to a method for the application of a support device, comprising the steps of:

providing a hollow elongate member, more particular a pile;

closing the hollow elongate member by arranging at least a first seal at a distance above the ground level, thereby forming a substantially fluid tight confined space;

arranging a first fluid in said confined space; and arranging at least one damping means in pressure connection with said first fluid in said confined space.

According to a preferred embodiment, the step of arranging a damping means in pressure connection with said fluid in said confined space is performed after the pile has been driven into the ground.

According to a further preferred embodiment, said method further comprises the step of pressurizing and/or adjusting the pressure of the first fluid inside said confined space with a fluid pump.

According to a further preferred embodiment, said method further comprises the step of adjusting the pressure of the pressurized gas inside said damping means with a gas pump.

According to a further preferred embodiment, said method further comprises the step of arranging multiple damping means.

According to a further preferred embodiment, said method further comprises the step of adjusting the height position of at least one damping means that is arranged inside said substantially fluid tight confined space of the hollow elongate member.

According to a further preferred embodiment, said damping means are removable from the confined space inside said elongate member, which allows for easy maintenance including, but not limited to extraction, replacement and repairs of the damping means.

According to a further preferred embodiment, said method further comprises the step of restricting the pressure connection between the at least one damping means and the pressurized first fluid in said confined space by arranging at least one dividing wall with one or more restriction openings in said pressure connection.

According to a further preferred embodiment, said method further comprises the step of adjusting the pressure connection between the at least one damping means and the first fluid in said confined space by arranging at least two dividing walls with one or more restriction openings each in said pressure connection, and moving said at least two dividing walls relative to each other in order to adjust the alignment of said one or more restriction openings in said dividing walls.

According to a further preferred embodiment, said method further comprises the step of closing off said fluid tight confined space with a second seal.

According to a further preferred embodiment, said method further comprises the step of adjusting the position of said second seal.

According to a further preferred embodiment, said method is applied using a device according to the invention.

BRIEF DESCRIPTION OF THE DRAWINGS

In the following description preferred embodiments of the present invention are further elucidated with reference to the drawing, in which:

FIGS. 8*a*-1A and 8*a*-2A show a cross sectional view of two successive steps of adjusting the alignment through rotation of the damping means comprising two dividing walls (sphere shaped) with restriction openings according to a further embodiment;

FIGS. 8*a*-1B and 8*a*-2B show a plan view of the successive steps from FIGS. 8*a*-1A and 8*a*-2A respectively;

FIGS. 8*a*-1C and 8*a*-2C show a detailed side view of the alignment of the restriction openings in the successive steps from FIGS. 8*a*-1A and 8*a*-2A respectively;

FIG. 8*b*-1 is a cross sectional view of the damping means according to a further embodiment comprising two dividing walls (half-sphere shaped) with restriction openings configured for rotational alignment;

FIGS. 8*b*-2 and 8*b*-3 show a cross sectional view of the two successive steps of adjusting the alignment through elevation of the damping means from FIG. 8*b*-1;

FIGS. 8*b*-4 and 8*b*-5 show a cross sectional view of the two successive steps of adjusting the alignment through rotation of the damping means from FIG. 8*b*-1;

FIGS. 12-1, 12-2, 12-3 and 12-4 show a representation of the steps taken for closing off the fluid tight confined space with a second seal;

FIGS. 13*a*-1 and 13*a*-2 show a detailed cross sectional view of two successive steps of arranging a second seal in the hollow member using a bolted connection according to a further embodiment;

FIGS. 13*b*-1 and 13*b*-2 show a detailed cross sectional view of two successive steps of arranging a second seal in the hollow member using a pin connection according to a further embodiment;

FIGS. 13*c*-1 and 13*c*-2 show a detailed cross sectional view of two successive steps of arranging a second seal in the hollow member using a self-locking pin connection according to a further embodiment;

FIGS. 16*a*-1 and 16*a*-2 show two successive steps of arranging a second seal according to a further embodiment, wherein said second seal stretches during installation;

FIGS. 16*b*-1, 16*b*-2 and 16*b*-3 show three successive steps of arranging a second seal according to a further embodiment, wherein said second seal comprises an isolated core of inert material;

DETAILED DESCRIPTION

Figure 1:
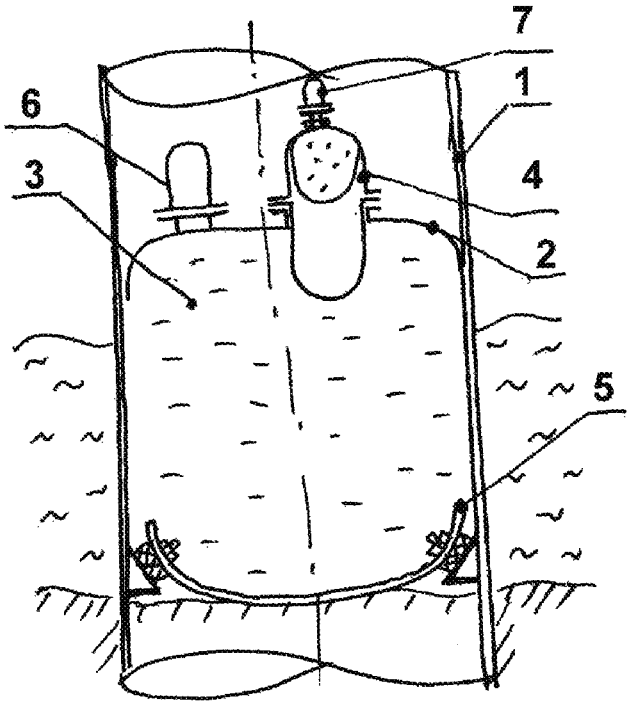
FIG. 1 is a schematic cross sectional view of the device according to a first embodiment.

In the cross sectional view shown in FIG. 1, the support device according to the invention comprises a hollow elongate member 1 which on the top side thereof is closed with a first seal 2. First seal 2 is fixed to the elongate member 1, e.g. via welding both seal 2 and elongate member 1 together. The elongate member 1, which in the shown embodiment comprises a pile, comprises on the bottom side thereof a second seal 5, which is connected to the elongate member 1 via a bolt connection. The hollow elongate member 1, the first seal 2 on the topside thereof and the second seal 5 on the bottom side thereof together form a confined space which is filled with a first fluid 3. The embodiment further comprises damping means 4, which in the shown embodiment of FIG. 1 are arranged on the first seal, to which they are attached via flanges. Furthermore a fluid pomp 6 is arranged on the first seal 2 via a flange connection, and damping means are provided with a gas pomp 7.

Figure 2A:
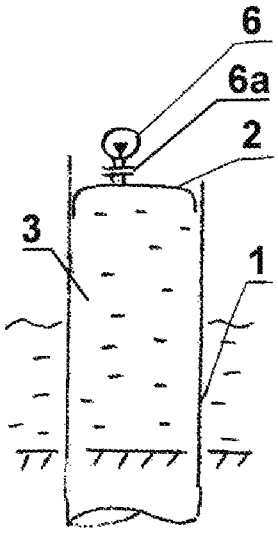
FIG. 2*a* is a schematic cross sectional view of an embodiment with the fluid pump arranged on the first seal.
Figure 2B:
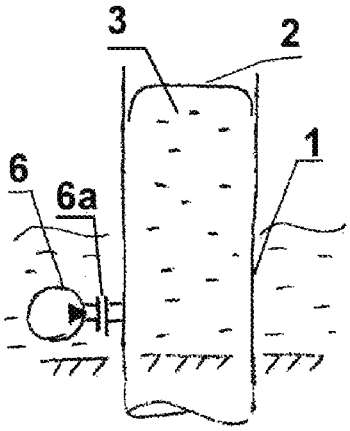
FIG. 2*b* is a schematic cross sectional view of an embodiment with the fluid pump arranged below the water level, on the outside of the elongate member.
Figure 2C:
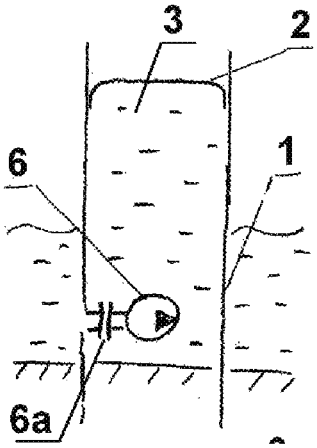
FIG. 2*c* is a schematic cross sectional view of an embodiment with the fluid pump arranged below the water level, on the inside of the elongate member.

The cross sectional views of FIGS. 2*a*, 2*b* and 2*c* show three alternative embodiments wherein the fluid pomp 6 is arranged at different locations, i.e. to the first seal 2 (FIG. 2*a*), and below the water level (FIGS. 2*b* and 2*c*). When the fluid pomp 6 is arranged below the water level, the surrounding pressure at that specific depth can be used to the advantage of the fluid pomp 6. The depth of attachment depends on maintenance restrictions and a required internal pressure of the first fluid 3. If the fluid pomp is arranged outside the hollow elongate member 1 as shown in FIG. 2*b*, fluid pomp 6 is easily available for maintenance. However, the embodiment shown in FIG. 2*c* has the advantage that the hollow elongate member 1 shields the fluid pomp 6 from the environment so that it is less vulnerable.

Figure 2D:
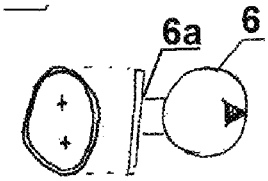
FIG. 2*d* is a detailed schematic view of the pump of the embodiment of FIG. 2*c;*

FIG. 2*d* shows that the fluid pomp 6 of FIG. 2*c* is arranged using a flange with an elliptical cross section for easy removal and replacement.

Figure 3:
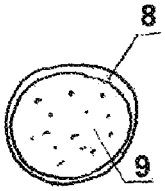
FIG. 3 is a schematic cross sectional view of an embodiment of the damping means comprising a compressible volume with a gas core.
Figure 4:
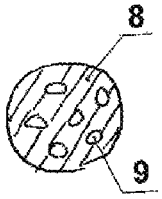
FIG. 4 is a schematic cross sectional view of an embodiment of the damping means comprising a compressible volume with multiple gas cores.

In the embodiment shown in FIG. 3, the damping means 4 comprise a compressible volume 8 with a gas filled core 9, whereas the embodiment shown in FIG. 4 comprises multiple gas filled cores 9 in the compressible volume 8.

Figure 5A:
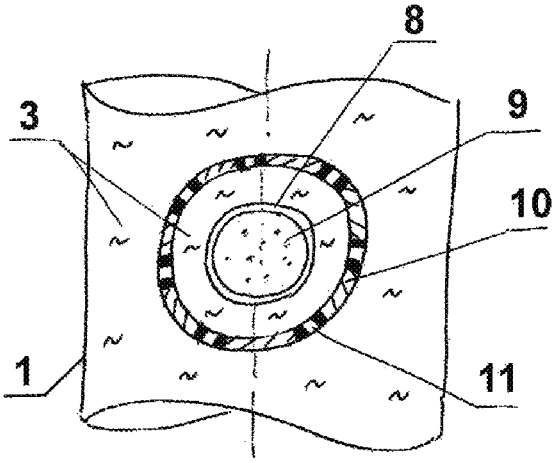
FIG. 5*a* is a schematic cross sectional view of an embodiment of the damping means comprising a compressible volume and a spherical dividing wall.
Figure 5B:
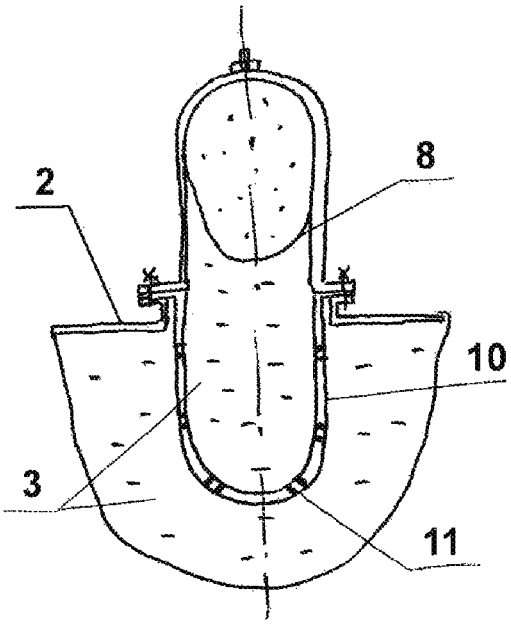
FIG. 5*b* is a schematic cross sectional view of an embodiment of the damping means comprising a compressible volume and a half-spherical dividing wall.

FIGS. 5*a* and 5*b* show two alternative embodiments, both comprising a compressible volume 8 with a gas filled core 9. The compressible volume 8 is in pressure connection with the elongated member 1 via the first fluid 3 that is arranged in the confined space within the hollow elongated member 1. In FIG. 5*a*, the compressible volume 8 is surrounded by a spherical dividing wall 10 with restriction openings 11 in its wall allowing the first fluid 3 to flow through. In the embodiment shown in FIG. 5*b*, the dividing wall 10 also comprises restriction openings 11, but now has the shape of a half-sphere that is arranged directly on first seal 2.

Figure 6A:
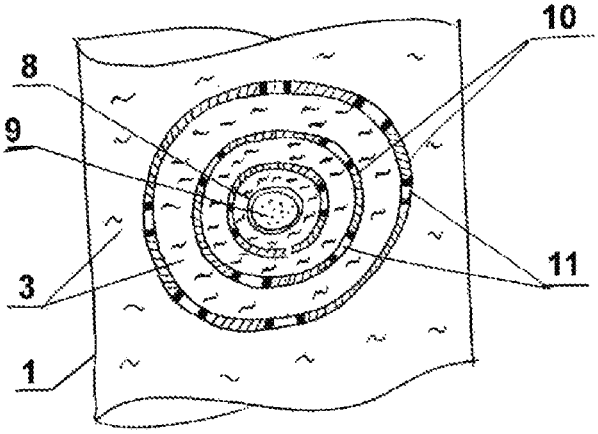
FIGS. 6*a* and 6*b* are schematic cross sectional views of embodiments of the damping means comprising a compressible volume and multiple dividing walls.
Figure 6B:
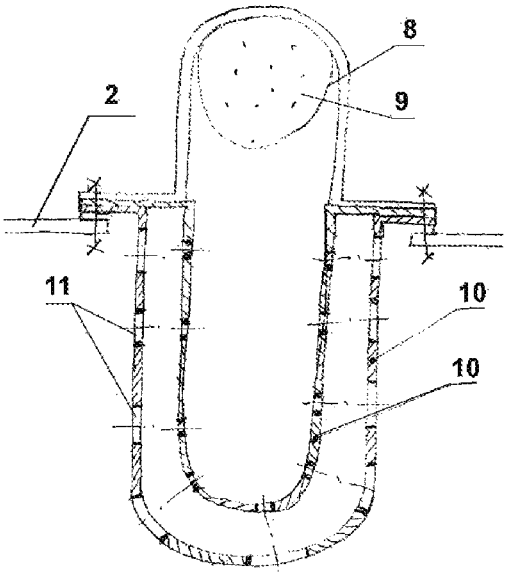

FIGS. 6*a* and 6*b* show embodiments in conformity with FIGS. 5*a* and 5*b* respectively. The difference between FIG. 5 and FIG. 6 is that there are arranged multiple dividing walls 10 between the compressible volume 8 with the gas filled core 9 and the first fluid 3 arranged within the confined space of the hollow elongate member 1.

Figure 7A:
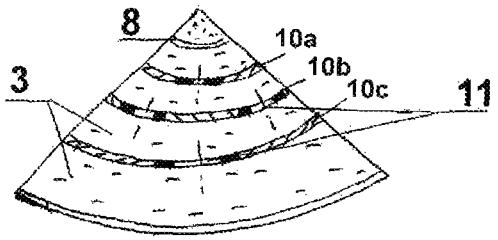
FIG. 7*a* is a detailed cross sectional view of FIG. 6*a* wherein the restriction openings of the dividing walls are positioned out of alignment rotationally.
Figure 7B:
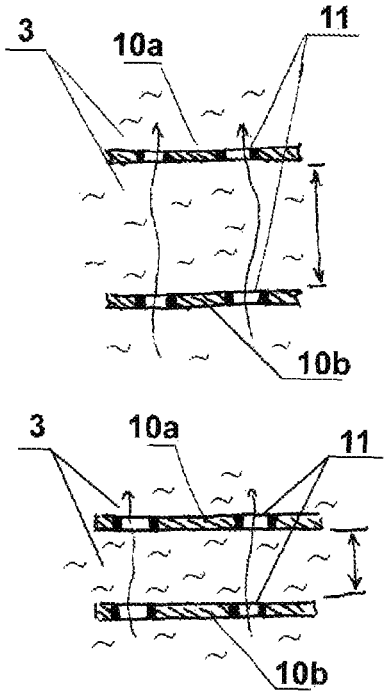
FIG. 7*b* is a detailed cross sectional view of an alternative embodiment in conformity with FIG. 6*a*, wherein the dividing walls are positioned at a different distance.
Figure 7C:
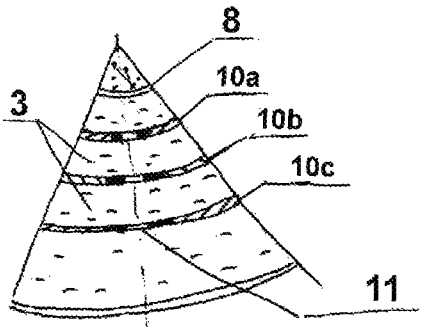
FIG. 7*c* is a detailed cross sectional view of an alternative embodiment in conformity with FIG. 6*a*, wherein the restriction openings of the dividing walls are configured with the same size.
Figure 7D:
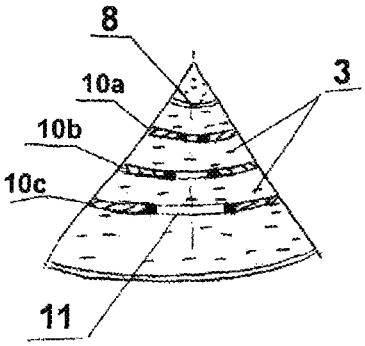
FIG. 7*d* is a detailed cross sectional view of an alternative embodiment in conformity with FIG. 6*a*, wherein the restriction openings of the dividing walls are configured with different sizes.

In a further preferred embodiment that is shown in FIGS. 7*a*-7*d*, the dividing walls 10 are movable relative to each other, allowing for the restriction openings 11 arranged in said dividing walls 10 to be brought in alignment or out of alignment and in this way influence the restriction that the pressure connection between the damping means 4 and the first fluid 3 in the hollow elongate member 1 experiences. In FIG. 7*a*, the dividing walls 10*a*, 10*b* and 10*c* are positioned with their restriction openings 11 out of alignment. In FIG. 7*b* a translational repositioning of the restriction openings 11 has taken place.

Furthermore, the restriction openings 11 in the dividing walls 10*a*, 10*b* and 10*c* may have the same size (FIG. 7*c*) to allow for maximal flow when they are aligned, or alternatively may be provided with restriction openings 11 that have an increasing size (FIG. 7*d*), so that they may be aligned to achieve a constant energy dissipation.

Figures 1A, 8A:
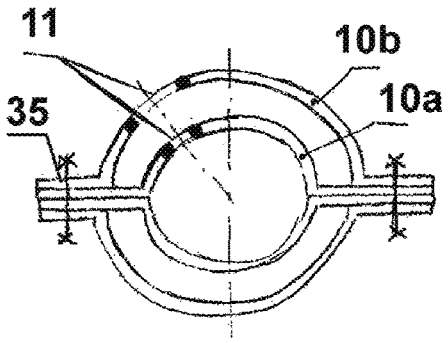
Figures 2A, 8A:
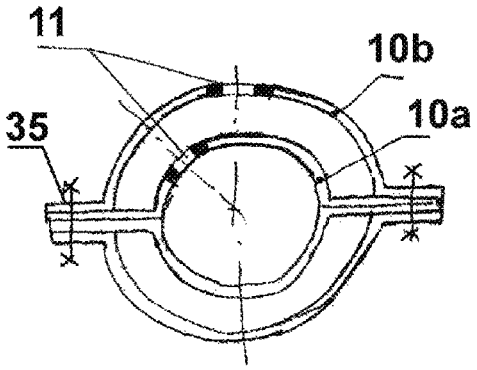
Figures 1B, 8A:
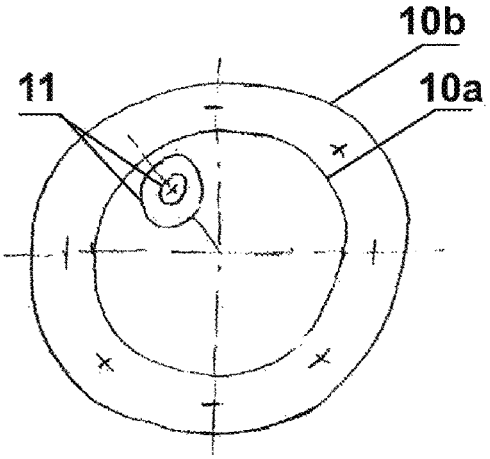
Figures 2B, 8A:
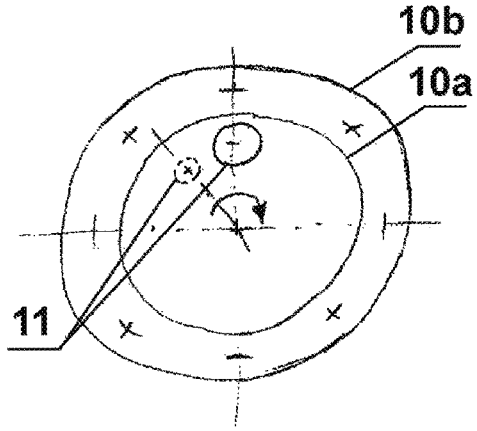
Figures 1C, 8A:
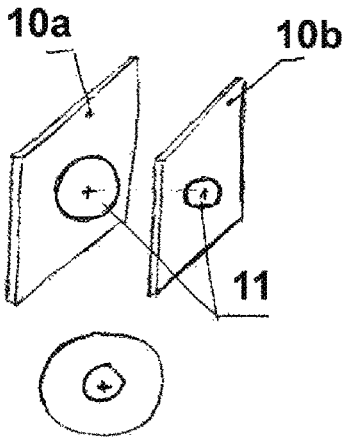
Figures 2C, 8A:
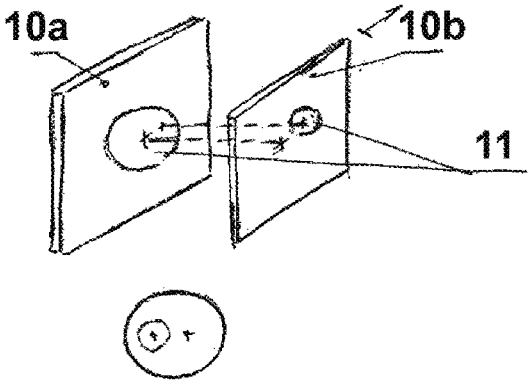
Figures 1, 8B:
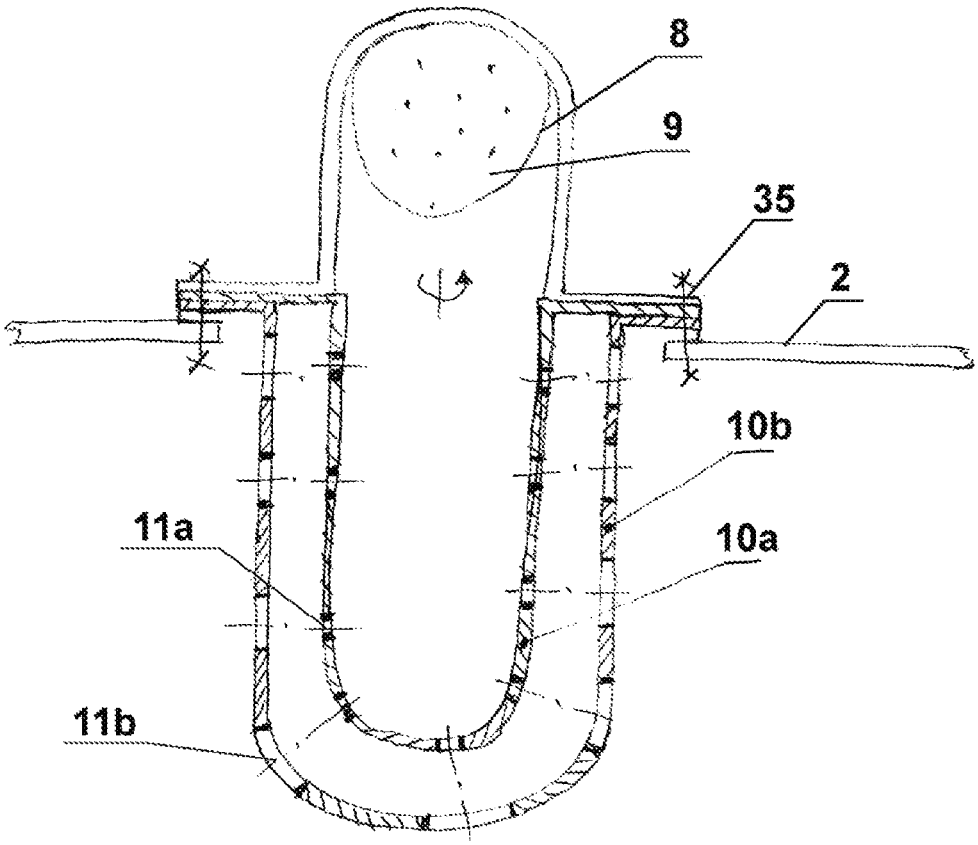

In a further preferred embodiment that is shown in FIGS. 8*a* and 8*b*, the dividing walls 10 are rotatable relative to each other, allowing again for the restriction openings 11 arranged in said dividing walls 10 to be brought in alignment or out of alignment and in this way influence the restriction that the pressure connection between the damping means 4 and the first fluid 3 in the hollow elongate member 1 experiences.

FIG. 8*a*-1A shows a cross sectional view of the damping means 4 comprising the dividing walls 10*a* and 10*b* (sphere-shaped) attached to each other via a bolted flange 35 and positioned with their restriction openings 11 in alignment. FIGS. 8*a*-1B and 8*a*-1C show the plan—and side views of this embodiment.

In FIG. 8*a*-2A a rotational repositioning of the restriction openings 11 has taken place by adjusting the bolted flange 35. FIGS. 8*a*-2B and 8*a*-2C show the plan- and side views of this state.

FIG. 8*b*-1A shows a cross sectional view of the damping means 4 comprising the dividing walls 10*a* and 10*b* (half sphere-shaped) attached to the said first seal 2 via a bolted flange 35 and positioned with their restriction openings 11 in alignment.

Figures 2, 8B:
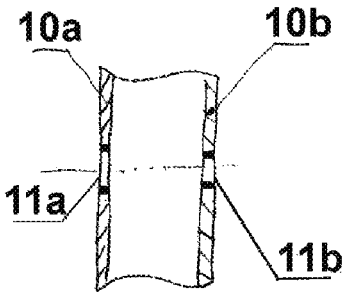
Figures 3, 8B:
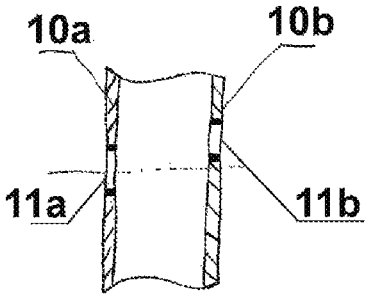
Figures 4, 8B:
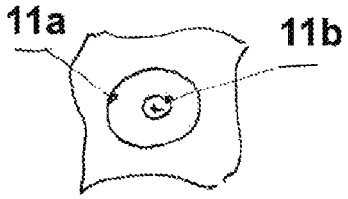
Figures 5, 8B:
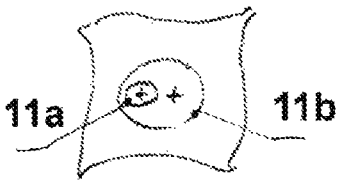
Figure 9A:
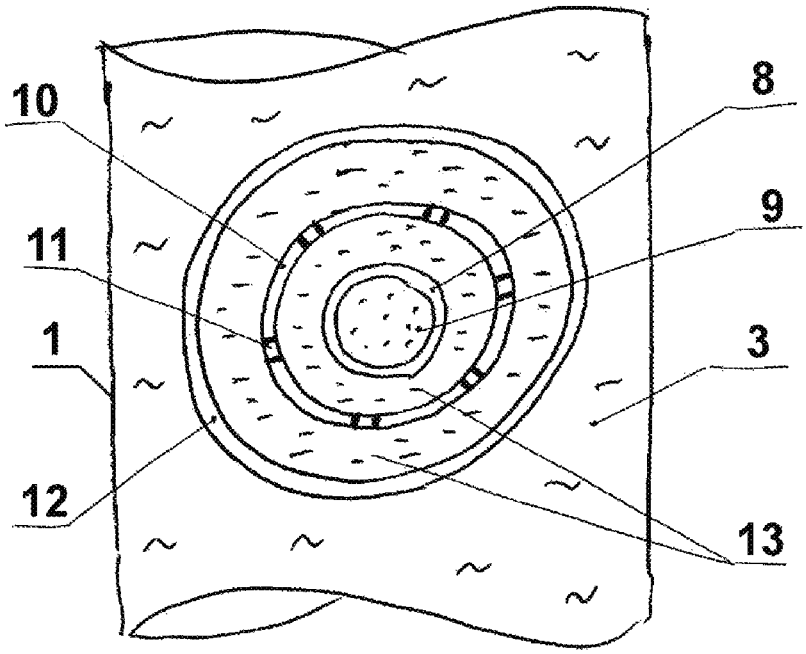
FIG. 9*a* is a cross sectional view of the damping means according to a further embodiment, wherein said damping means comprise a compressible volume, a spherical dividing wall and a fluid tight flexible member.

FIGS. 8*b*-2 and 8*b*-3 show a cross sectional view of the two successive steps of adjusting the alignment of the restriction openings 11 through elevation of the inner dividing wall 10*b* relative to the outer dividing wall 10*a* by adjusting the flange 35;

FIGS. 8*b*-4 and 8*b*-5 show a cross sectional view of the two successive steps of adjusting the alignment of the restriction openings 11 through rotation of the inner dividing wall 10*b* relative to the outer dividing wall 10*a* by adjusting the flange 35;

FIG. 9*a* shows a cross sectional view of the damping means 4 comprising a compressible volume 8 with a gas filled core 9. The compressible volume 8 is enclosed by a fluid tight flexible member 12 and is in pressure connection with it via a second fluid 13. Between the compressible volume 8 and the fluid tight flexible member 12 the dividing wall 10 is placed with restriction opening 11 in its surface restricting the flow of the second fluid 13. The fluid tight flexible member 12 is in turn in pressure connection with the hollow elongate member 1 through the first fluid 3.

Figure 9B:
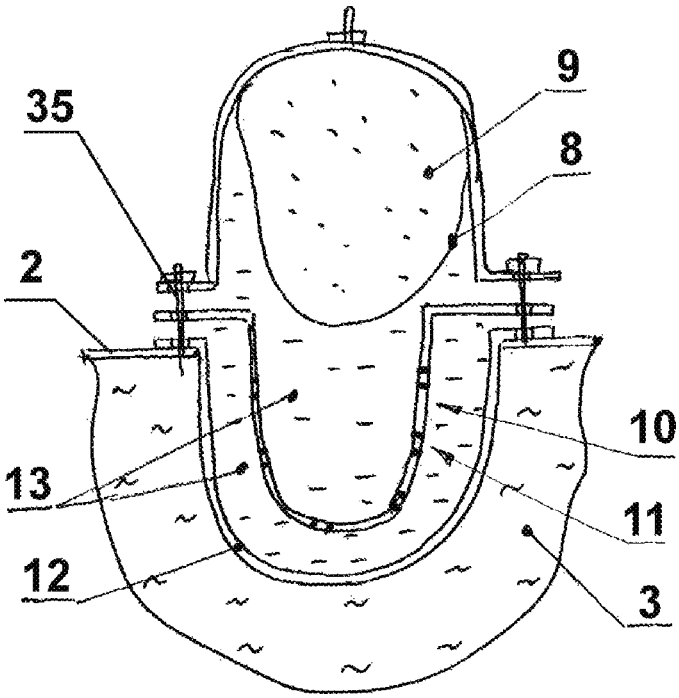
FIG. 9*b* is a cross sectional view of the damping means according to a further embodiment, wherein said damping means comprise a compressible volume, a half-spherical dividing wall and a fluid tight flexible member.

FIG. 9*b* shows a cross sectional view of the damping means 4 comprising a compressible volume 8 with a gas filled core 9. The compressible volume 8 is enclosed by a fluid tight flexible member 12 and is in pressure connection with it via the second fluid 13. Between the compressible volume 8 and the fluid tight flexible member 12 the dividing wall 10 is placed with restriction openings 11 in its surface restricting the flow of the second fluid 13. The dividing wall 10 and the fluid tight flexible member 12 are connected to the first seal 2 through a bolted flange 35. The fluid tight flexible member 12 is in turn in pressure connection with the, hollow elongate member 1 via the first fluid 3.

Figure 10A:
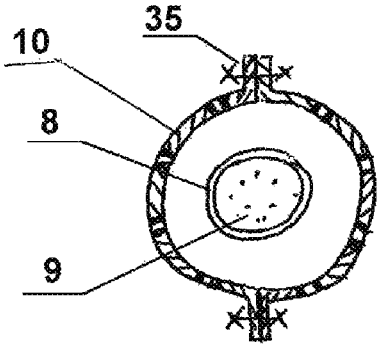
FIG. 10*a* is a cross sectional view of the damping means according to a further embodiment, configured for modular attachment and position adjustment.

FIG. 10*a* shows a cross sectional view of the damping means 4 comprising a compressible volume 8 with a gas filled core 9. The damping means 4 are surrounded by a dividing wall 10 comprising two half-spheres attached to each other via a bolted flange 35.

Figure 10B:
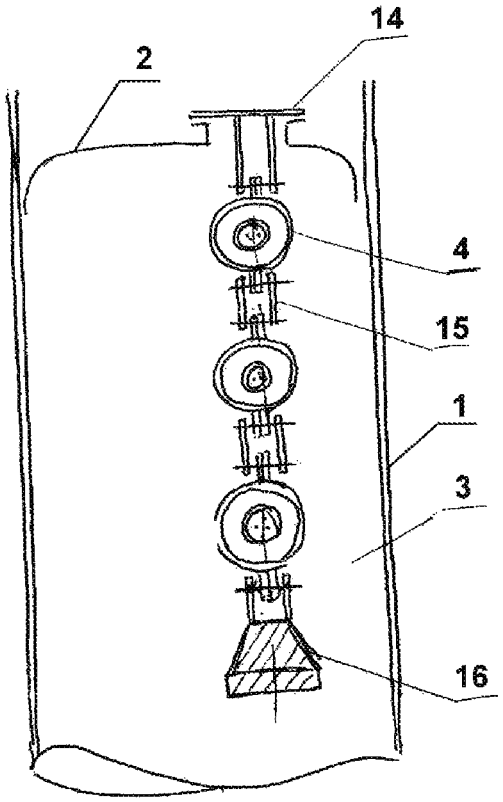
FIG. 10*b* is a cross sectional view of the damping means according to a further embodiment, comprising multiple damping means arranged at a fixed positioning within the elongate member.

FIG. 10*b* shows a cross sectional view of a support device comprising multiple damping means 4 connected to each other with a rigid connector 15. The upper damping means 4 is attached to the first seal 2 via a closing flange 14 that keeps the elongate member 1 water tight for the first fluid 3. The bottom damping means 10 is connected to a weight 16 that keeps the chain of connectors 15 and damping means 4 stretched.

Figure 10C:
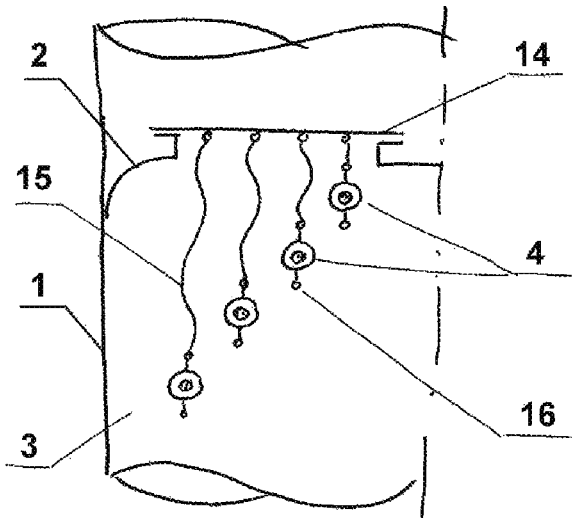
FIG. 10*c* is a cross sectional view of the damping means according to a further embodiment, wherein multiple damping means configured for a flexible positioning and extraction within the elongate member.

FIG. 10*c* shows a cross sectional view of a support device comprising multiple damping means 4 connected to the first seal 2 with flexible connectors 15 with different length allowing them to reach different depths. The top end of the flexible connector is attached to the closing flange 14 that keeps the elongate member 1 water tight for the first fluid 3. To the bottom of the damping means 10 is connected a weight 16 that keeps it stretched.

Figure 11:
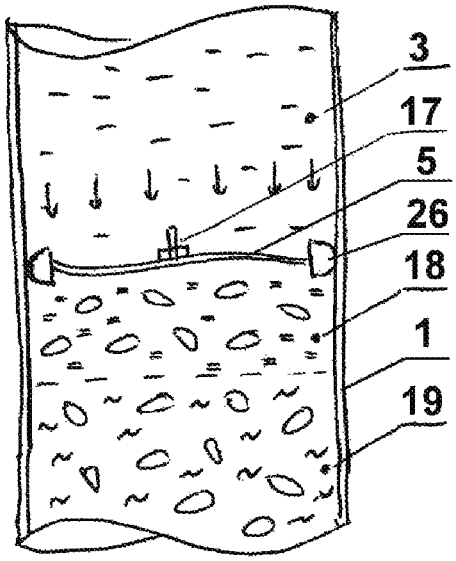
FIG. 11 is a cross sectional view of the damping means according to a further embodiment, comprising a second seal configured for fluid transfer from the hollow member to the soil enclosed by said elongate member.

FIG. 11 shows a cross sectional view of a support device comprising a second seal 5 installed in the hollow elongate member 1 and attached to it by seal 26. The second seal 5 comprises a means of transferring fluid 17, such as oil, from the hollow member 1 to the soil where it stays in the top layer of soil saturated with the second fluid 18. Below this layer there remains a certain layer of soil saturated with water 19. The depth of the border between the two layers depends on the amount of second fluid transferred.

Figures 1, 12:
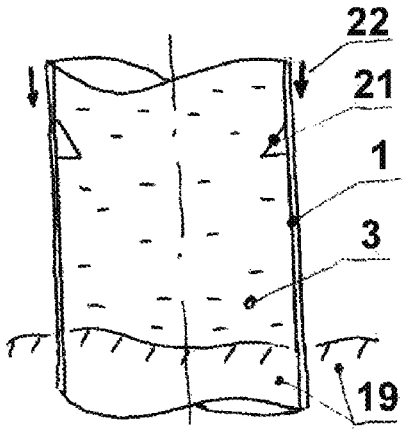
Figures 2, 12:
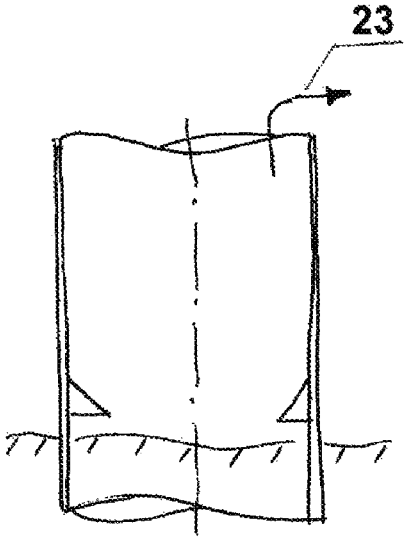
Figures 3, 12:
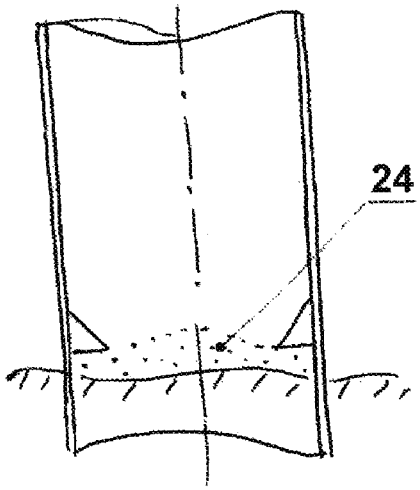
Figures 4, 12:
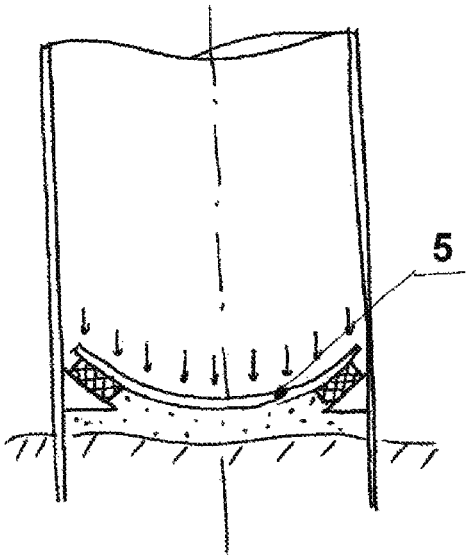

FIG. 12 shows a hollow elongate member (in particular a pile) 1 that has been driven 22 open-ended with a facility for attachment, a flange 21, on the inside. After the pile has reached the desired depth (FIG. 12-2), the first fluid 3 is optionally pumped out 23 and a layer of flexible filler material 24, e.g. sand, is poured on top of the soil 19 (FIG. 12-3). On top of that layer the second seal 5 is attached to the flange 21 where it partially rests on the flexible material 24 and partially on the flange depending on the pressure (FIG. 12-4). The hollow elongate member 1 is thus closed off on the bottom side and filled back with the first fluid 3.

Figures 1, 13A:
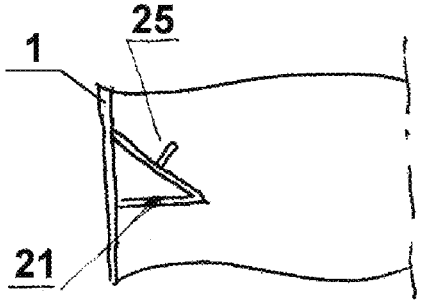
Figures 2, 13A:
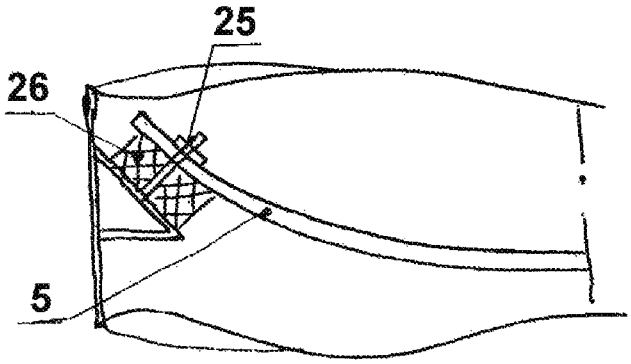

FIG. 13*a* shows a cross sectional view of a second seal 5 configured for a bolted connection to the hollow member. On the inside of the hollow elongate member 1 and in its circumference a flange 21 is arranged (FIG. 13*a*-1). On top of this flange 21, the flexible seal 26 (e.g. from rubber) is laid, on top of which the second seal 5 is placed (FIG. 13*a*-2). The second seal 5 is fastened to the flange 21 with a bolted connection 25, pressing the flexible seal 26 together and creating a water tight connection.

Figures 1, 13B:
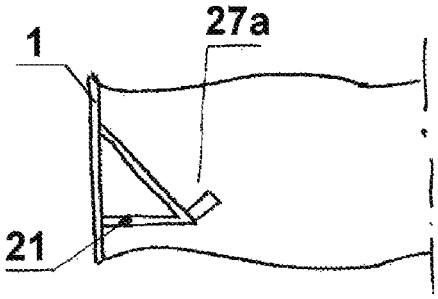
Figures 2, 13B:
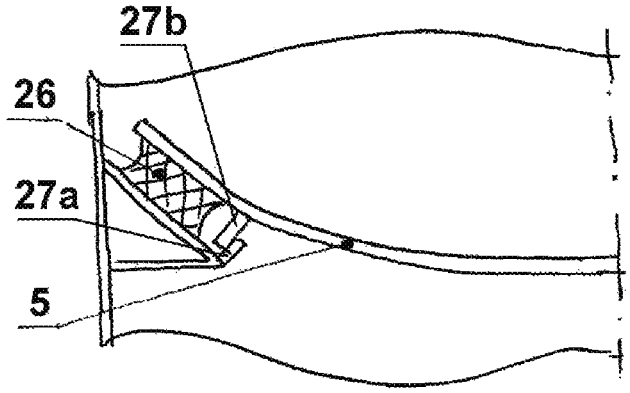

FIG. 13*b* shows a cross sectional view of a second seal 5 configured for a pin connection to the hollow member. On the inside of the hollow elongate member 1 and in its circumference a flange 21 is arranged (FIG. 13*b*-1). On top of this flange 21, the flexible seal 26 (e.g. from rubber) is laid, on top of which the second seal 5 is placed (FIG. 13*b*-2). The second seal 5 is fastened to the flange 21 with a pin connection 27*a*, 27*b* pressing the flexible seal 26 together, with its weight and water pressure, and creating a water tight connection.

Figures 1, 13C:
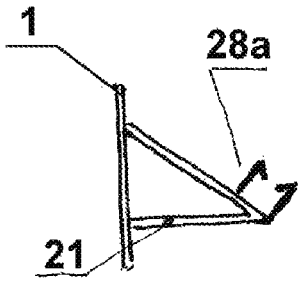
Figures 2, 13C:
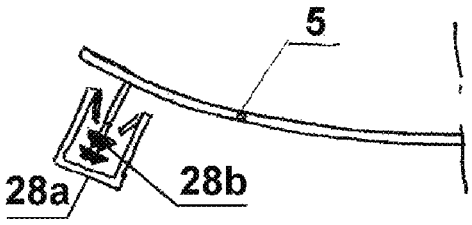

FIG. 13*c* shows a cross sectional view of a second seal 5 configured for a self-locking pin connection to the hollow member 1. On the inside of the hollow elongate member 1 and in its circumference a flange 21 is arranged (FIG. 13*c*-1). On top of this flange 21 is arranged a lock slot 28*a*. On the bottom side of the second seal 5 is arranged a fitting lock pin 28*b*. The second seal 5 is connected to the flange 21 by clicking the pin 28*b* into the slot 28*a* creating a water tight connection (FIG. 13*c*-2).

Figure 14:
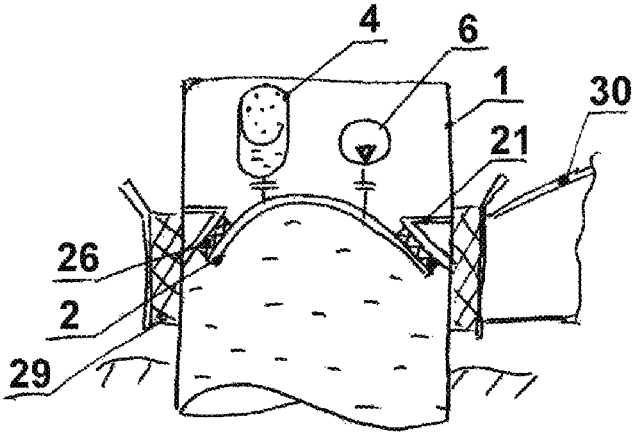
FIG. 14 is a cross sectional view of a first seal according to a further embodiment, wherein said first seal is arranged on the hollow member using a fixed connection.

FIG. 14 shows a cross sectional view of a first seal configured for a fixed connection to the hollow member. On the inside of the hollow elongate member 1 and in its circumference a flange 21 is arranged. On top of this flange 21, the flexible seal 26 (e.g. from rubber) is placed, on which the first seal 2 is arranged. On top of this first seal 2 a damping means 4 and the fluid pump 6 are installed with flanges. The hollow elongate member 1 is connected on the outside to the surrounding structure 29 with a sealant 30 between the two.

Figure 15A:
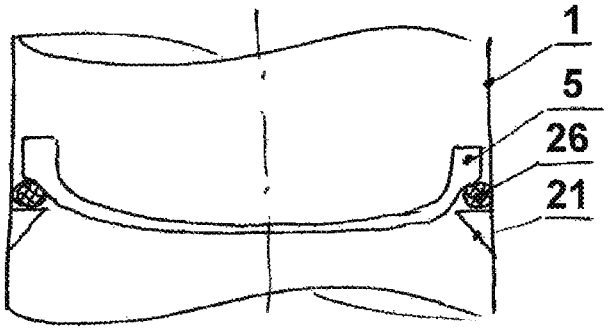
FIG. 15*a* is a cross sectional view of a second seal according to a further embodiment, wherein said second seal is arranged movable in the hollow member using a support flange.

FIG. 15*a* shows a cross sectional view of a second seal 5 configured for a sliding arrangement in the hollow member, where it is supported by a flange. On the inside of the hollow elongate member 1 and in its circumference a flange 21 is arranged. On top of this flange 21 a flexible seal 26 is placed on top of which the second seal 5 is placed. The flexible seal 26 allows the second seal 5 to slide in a vertical direction depending on the water pressure while keeping a water tight connection.

Figure 15B:
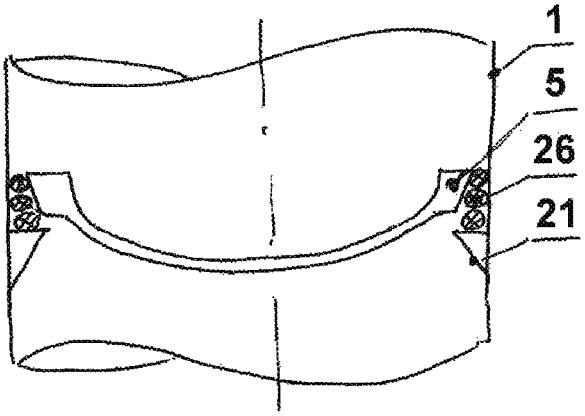
FIG. 15*b* is a cross sectional view of a second seal according to a further embodiment, wherein said second seal is arranged movable in the hollow member using a support flange and a conical interface between said seal and flange.

FIG. 15*b* shows a cross sectional view of a second seal 5 configured for a sliding arrangement, with a conical cross section to the hollow member, supported by a flange. On the inside of the hollow elongate member 1 and in its circumference a flange 21 is arranged. On top of this flange 21 a flexible seal 26 is placed on top of which the second seal 5 is placed. The flexible seal 26 allows the second seal 5 to slide in a vertical direction depending on the water pressure while keeping a water tight connection. The edge of the second seal 5 has a conical cross section allowing for an increased contact surface to the flexible seal 21 and also pressing the flexible seal 21 against the walls of the elongate member 1 beside the flange 21.

Figure 15C:
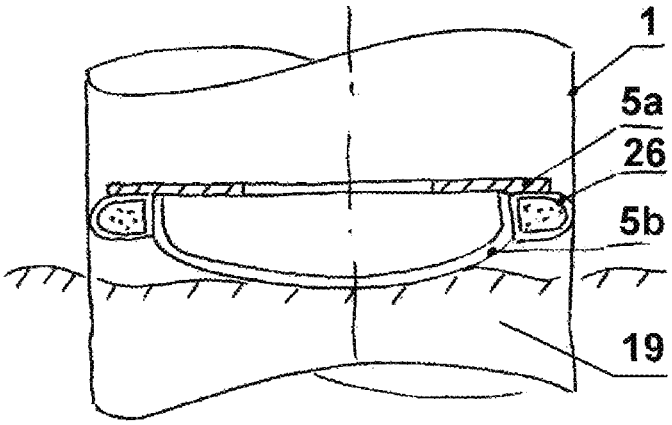
FIG. 15*c* is a cross sectional view of a second seal according to a further embodiment, wherein said second seal is arranged movable in the hollow member support by the soil.

FIG. 15*c* shows a cross sectional view of a second seal 5 configured for a sliding arrangement in the hollow member without a restricting flange. The second seal 5 comprises two parts—a bottom section 5*b* and an upper rigid edge 5*a* (e.g from steel). The upper rigid edge 5*a* has a smaller diameter than the inner diameter of the hollow elongate member 1. The flexible seal 26 is placed underneath the upper rigid edge 5*a* of the second seal, as shown in FIG. 15*c*, and together they slide down the hollow elongate member 1 until the bottom section of the second seal 5*b* rests on the soil 19. In this way a water tight connection is created while the second seal 5*a*, 5*b* can slide in a vertical direction depending on the internal pressure in the hollow member 1.

Figures 1, 16A:
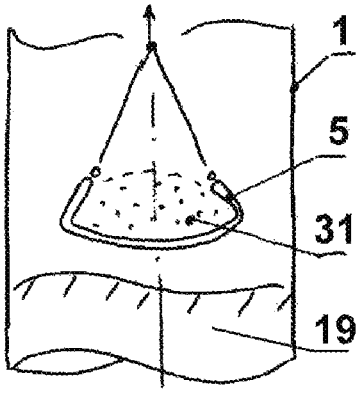
Figures 2, 16A:
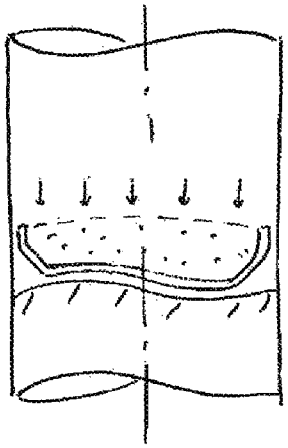

FIG. 16*a* shows a cross sectional view of a second seal 5 embodiment that stretches during installation. The second seal 5 is in an initial folded state with an open top side. It is filled with an inert material 31 (e.g. sand) forming a bag and is lowered into the hollow member 1 (FIG. 16*a*-1). The second seal 5 rests on the soil 19 and the inert material 31 spreads out under its own weight (FIG. 16*a*-2) and presses the edges of the second seal 5 against the inner wall of the hollow member 1 creating a water tight connection.

Figures 1, 16B:
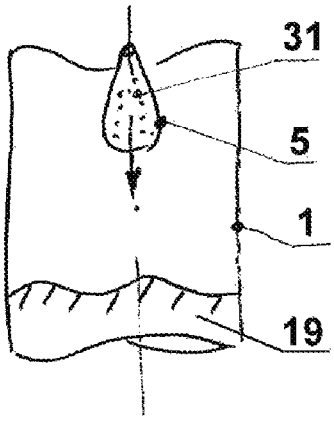
Figures 2, 16B:
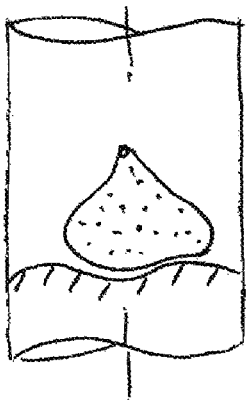
Figures 3, 16B:
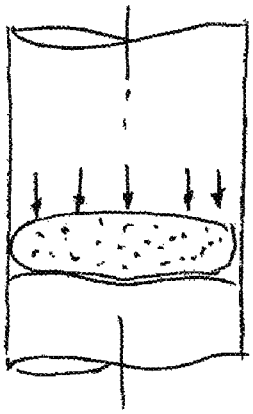

FIG. 16*b* shows a cross sectional view of a second seal 5 that stretches during installation, said second seal 5 comprising an isolated core of inert material. The second seal 5 is in an initial folded state. It is filled with an inert material 31 (e.g. sand) and completely closed. The second seal 5 is lowered into the hollow member 1 (FIG. 16*b*-1). The second seal 5 rests on the soil 19 and the inert material 31 spreads out under its own weight (FIG. 16*b*-2) and presses the edges of the second seal 5 against the inner wall of the hollow member 1 creating a water tight connection (FIG. 16*b*-3).

Figure 16C:
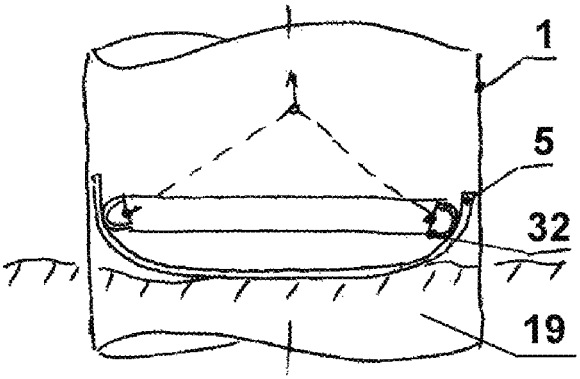
FIG. 16*c* show a step of arranging a second seal according to a further embodiment, wherein stretching of said second seal is facilitated using a ring.

FIG. 16*c* shows a cross sectional view of a second seal 5 embodiment that is stretched during installation by an additional ring. The second seal 5 rests on the soil 19 in the hollow member 1. A weight 32 in the form of a ring (e.g. from steel) with diameter smaller than the inner diameter of the hollow member 1 is lowered on top of the second seal 5. In this way it presses the seal against the inner wall of the hollow member 1 with its weight.

Figure 17A:
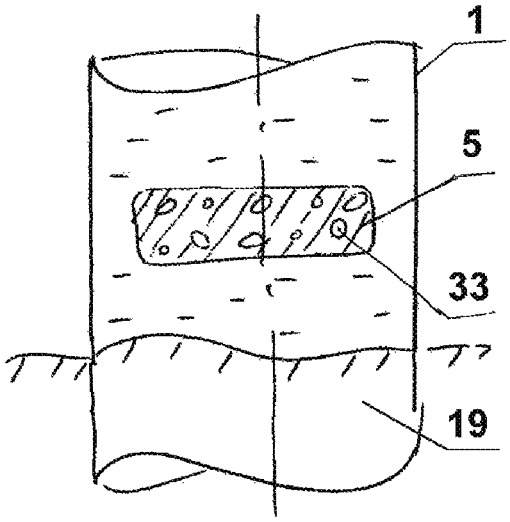
FIGS. 17*a* and 17*b* show two successive steps of arranging a second seal according to a further embodiment, wherein said second seal deforms and in this way forms a water tight connection with the hollow member.
Figure 17B:
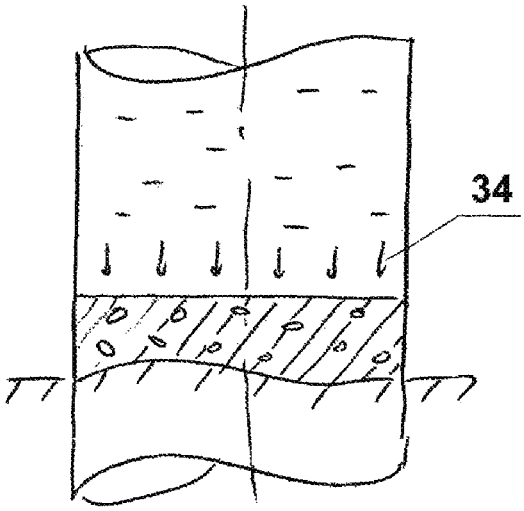

FIG. 17 shows a cross sectional view of a second seal 5 embodiment configured for a water tight connection to the hollow member by deformation. The second seal 5 is placed to rest in the soil 19 at the bottom of the hollow member 1 (FIG. 17*a*). The seal 5 has internal volumes 33 that are compressed by the internal fluid pressure 34. The second seal 5 is compressed in the vertical direction and spreads out in the horizontal direction (FIG. 17*b*). This makes the second seal 5 press against the inner wall of the hollow member 1 and create a water tight connection.

Although they show preferred embodiments of the invention, the above described embodiments are intended only to illustrate the invention and not to limit in any way the scope of the invention. Accordingly, it should be understood that where features mentioned in the appended claims are followed by reference signs, such signs are included solely for the purpose of enhancing the intelligibility of the claims and are in no way limiting on the scope of the claims. Furthermore, it is particularly noted that the skilled person can combine technical measures of the different embodiments, such as combining different damper types in a single support device. The scope of the invention is therefore defined solely by the following claims.

The invention claimed is:

1. A support device, comprising:

a hollow elongate member, the hollow elongate member being in a form of a pile;

a substantially fluid tight confined space with at least a first seal at a distance above ground level within the hollow elongate member;

wherein a first fluid is arranged in said confined space;

wherein at least one damping means is arranged in pressure connection with said first fluid in said confined space; and wherein the at least one damping means comprises at least one of:

a compressible volume that is in direct or indirect contact with the first fluid inside said confined space; or a foam or other compressible material with elastic properties.

2. The support device according to claim 1, wherein the first fluid in said confined space of said pile comprises a liquid.

3. The support device according to claim 1, wherein said support device further comprises a fluid pump configured for pressurizing the first fluid and/or adjusting a pressure of the first fluid inside said confined space, wherein either said fluid pump is arranged at a lower half of the distance between a ground level and a top of the hollow elongate member; or said fluid pump is arranged inside said hollow elongate member, or both.

4. The support device according to claim 1, wherein the damping means comprise a compressible volume that is in direct or indirect contact with the first fluid inside said confined space.

5. The support device according to claim 1, wherein the damping means comprise a gas, and wherein said device further comprises a gas pump configured for adjusting a pressure of the gas inside said damping means.

6. The support device according to claim 1, wherein the damping means are an integrated part of the first seal.

7. The support device according to claim 1, comprising at least one dividing wall with one or more restriction openings in the pressure connection between the at least one damping means and the first fluid in said confined space.

8. The support device according to claim 7, comprising at least two dividing walls, each of the at least two dividing walls having one or more restriction openings, wherein said dividing walls are moveable relative to each other in order to adjust an alignment of said one or more restriction openings in said dividing walls and/or the distance between said dividing walls, and wherein the dividing walls are rotatable relative to each other.

9. The support device according to claim 1, wherein the damping means comprises a rotation symmetric cross section.

10. The support device according to claim 1, wherein a fluid tight flexible member is arranged between the first fluid inside the confined space of the hollow elongate member and the at least one damping means, and wherein a volume between the fluid tight flexible member and the damping means comprises a second fluid that is different from the first fluid, wherein the second fluid is a liquid that has a higher viscosity than the first fluid.

11. The support device according to claim 1, comprising at least one of the following features:

wherein the at least one damping means is arranged inside said substantially fluid tight confined space of the hollow elongate member, and wherein the position of the at least one damping means inside said confined space is adjustable and/or predetermined, wherein said support device further comprises a control means configured for regulating damping of the support device by the damping means in a predetermined range; or wherein the damping means comprise a second seal, or a combination thereof.

12. The support device according to claim 11, wherein said second seal further comprises a port for transferring fluid into soil that is surrounded by the hollow elongate member.

13. A method for the application of a support device, comprising:

providing a hollow elongate member;

closing the hollow elongate member by arranging at least a first seal at a distance above a ground level, thereby forming a substantially fluid tight confined space within the hollow elongate member;

arranging a first fluid in said confined space; and arranging at least one damping means in pressure connection with said first fluid in said confined space;

wherein the at least one damping means comprises at least one of:

a compressible volume that is in direct or indirect contact with the first fluid inside said confined space; or a foam or other compressible material with elastic properties.

14. The method according to claim 13, wherein the step of arranging at least one damping means in pressure connection with said first fluid in said confined space is performed after the hollow elongate member has been driven into the ground.

15. The method according to claim 13, further comprising at least one of the following steps of:

pressurizing a first fluid and/or adjusting a pressure of the first fluid inside said confined space with a fluid pump, adjusting the pressure of a gas inside said damping means with a gas pump arranging multiple of the damping means, adjusting a height position of at least one damping means that is arranged inside said substantially fluid tight confined space of the hollow elongate member, or a combination thereof.

16. The method according to claim 15, wherein the damping means is removable within the confined space inside said elongate member.

17. The method according to claim 13, further comprising the step of restricting the pressure connection between the at least one damping means and the first fluid in said confined space by arranging at least one dividing wall with one or more restriction openings in said dividing wall.

18. The method according to claim 13, further comprising:

adjusting the pressure connection between the at least one damping means and the first fluid in said confined space by arranging at least two dividing walls, each of the at least two dividing walls having one or more restriction openings, in said pressure connection, and moving said at least two dividing walls relative to each other in order to adjust an alignment of said one or more restriction openings in said dividing walls, or closing off said fluid tight confined space with a second seal, or both.

19. The method according to claim 13, wherein the support device is provided, the support device being in the form of a pile and including the hollow elongate member.

* * * * *